US006575789B2

(12) United States Patent
Bassler et al.

(10) Patent No.: US 6,575,789 B2
(45) **Date of Patent: *Jun. 10, 2003**

(54) IMPEDANCE-TUNED TERMINATION ASSEMBLY AND CONNECTORS INCORPORATING SAME

(76) Inventors: Maxwill P. Bassler, 9N114 Burlington Rd., Hampshire, IL (US) 60140; David L. Brunker, 407 Verbena Ct., Naperville, IL (US) 60565; Daniel L. Dawiedczyk, 5538 E. Lake Dr., #A, Lisle, IL (US) 60532; John E. Lopata, 325 Hemlock La., Naperville, IL (US) 60540

( * ) Notice: Subject to any disclaimer, the term of this patent is extended or adjusted under 35 U.S.C. 154(b) by 0 days.

This patent is subject to a terminal disclaimer.

(21) Appl. No.: 10/246,962

(22) Filed: Sep. 19, 2002

(65) Prior Publication Data

US 2003/0017730 A1 Jan. 23, 2003

Related U.S. Application Data

(63) Continuation of application No. 09/540,605, filed on Mar. 31, 2000, now Pat. No. 6,454,605, which is a continuation-in-part of application No. 09/356,205, filed on Jul. 16, 1999, now Pat. No. 6,280,209.

(51) Int. Cl.[7] ..... H01R 13/648

(52) U.S. Cl. ..... 439/609; 439/101; 439/108

(58) Field of Search ..... 439/609, 108, 439/101

(56) References Cited

U.S. PATENT DOCUMENTS

| | | | | | |
|---|---|---|---|---|---|
| 4,717,354 | A | * | 1/1988 | McCleerey | 439/444 |
| 5,876,248 | A | * | 3/1999 | Brunker et al. | 439/108 |
| 5,895,276 | A | * | 4/1999 | Rothenberger | 439/108 |
| 6,116,926 | A | * | 9/2000 | Ortega et al. | 439/108 |

* cited by examiner

*Primary Examiner*—P. Austin Bradley
*Assistant Examiner*—Briggitte R. Hammond

(57) ABSTRACT

A termination structure for a cable connector having a pair of differential wire pairs and an associated ground wire utilizes a series of nests, or solder cups, that have their dimensions tailored to maintain a desired level of electrical performance. These nests are also arranged in a configuration to maintain the aforementioned electrical performance, and also position the ground and signal conductors of the cable in the termination area in the same position and orientation as they take in the cable.

3 Claims, 13 Drawing Sheets

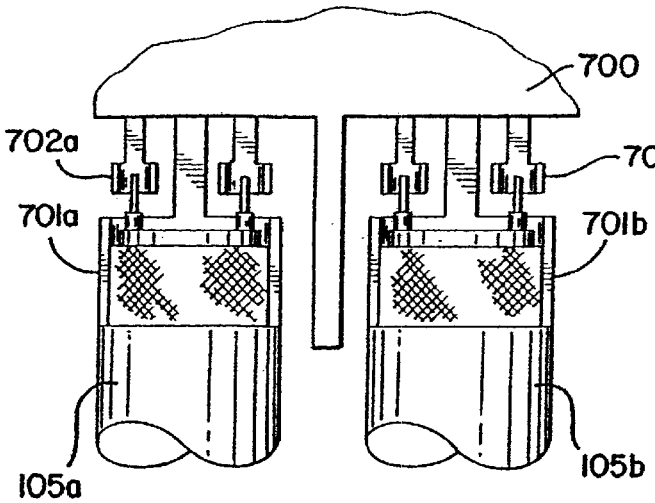
FIG. 21
FIG. 22A
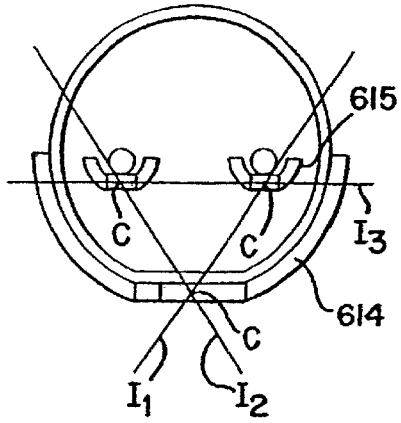
FIG. 22B
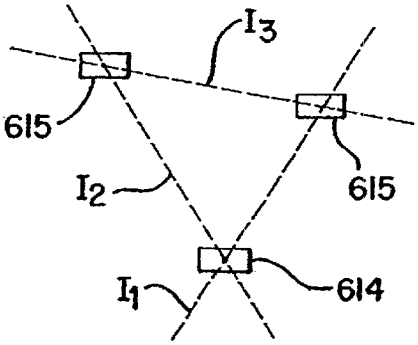
FIG. 22C
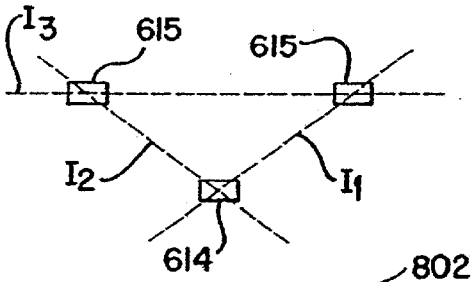
FIG. 23
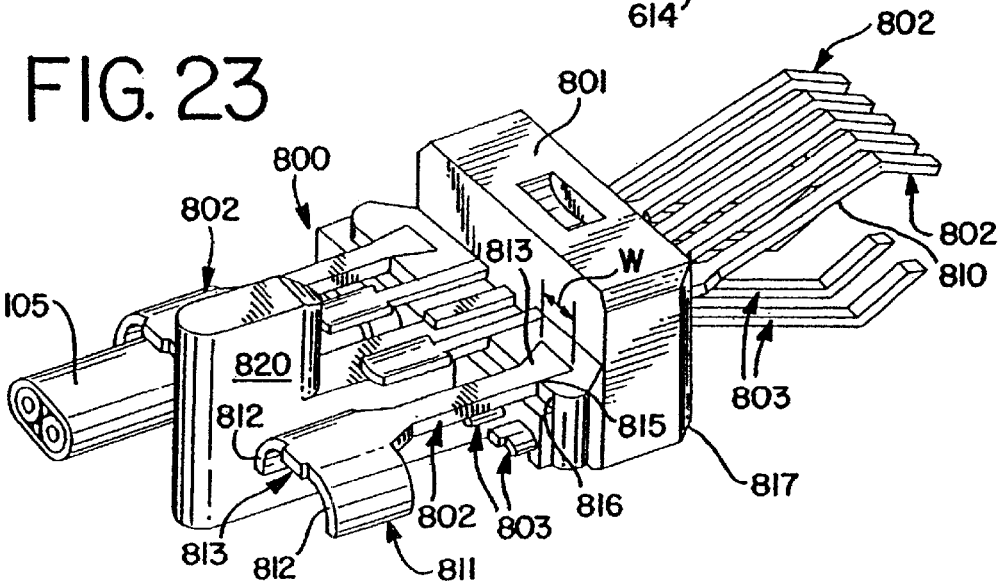

FIG. 26
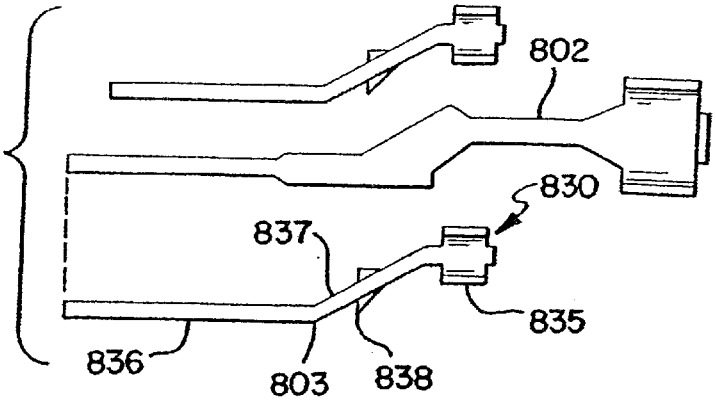
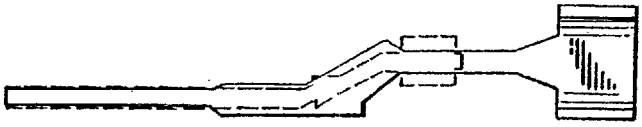
FIG. 27
FIG. 28A
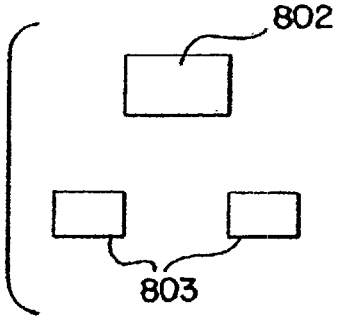
FIG. 28B
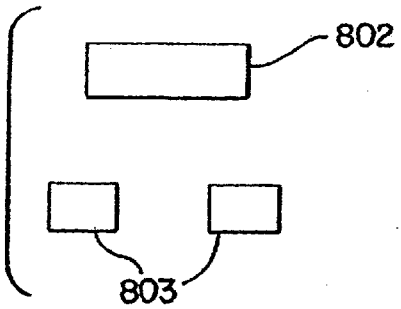
FIG. 28C
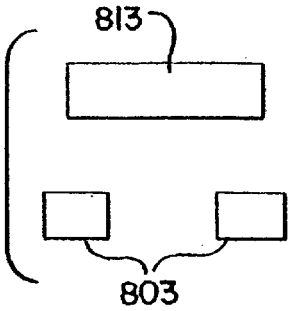
FIG. 28D
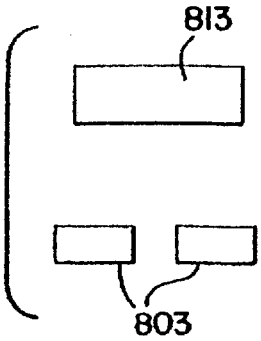
FIG. 28E
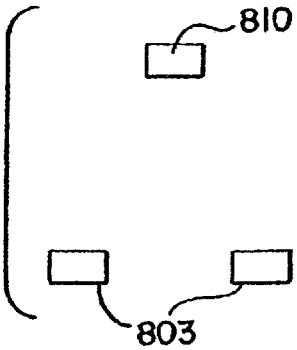

IMPEDANCE-TUNED TERMINATION ASSEMBLY AND CONNECTORS INCORPORATING SAME

REFERENCE TO RELATED APPLICATIONS

This application is a continuation application of prior application Ser. No. 09/540,605 filed Mar. 31, 2000, issued as U.S. Pat. No. 6,454,605 on Sep. 24, 2002, which is a continuation-in-part application of Ser. No. 09/356,205, filed Jul. 16, 1999, now U.S. Pat. No. 6,280,209.

BACKGROUND OF THE INVENTION

The present invention relates generally to terminations for connectors and more particularly to connectors used in connection with signal cables.

Many electronic devices rely upon transmission lines to transmit signals between related devices or between peripheral devices and circuit boards of a computer. These transmission lines incorporate signal cables that are capable of high-speed data transmissions.

These signal cables may use what are known as one or more twisted pairs of wires that are twisted together along the length of the cable, with each such twisted pair being encircled by an associated grounding shield. These twisted pairs typically receive complimentary signal voltages, i.e., one wire of the pair may see a +1.0 volt signal, while the other wire of the pair may see a −1.0 volt signal. Thus, these wires may be called "differential" pairs, a term that refers to the different signals they carry. As signal cables are routed on a path to an electronic device, they may pass by or near other electronic devices that emit their own electric field. These devices have the potential to create electromagnetic interference to transmission lines such as the aforementioned signal cables. However, this twisted pair construction minimizes or diminishes any induced electrical fields and thereby eliminates electromagnetic interference.

In order to maintain electrical performance integrity from such a transmission line, or cable, to the circuitry of an associated electronic device, it is desirable to obtain a substantially constant impedance throughout the transmission line, from circuit to circuit or to avoid large discontinuities in the impedance of the transmission line. The difficulty of controlling the impedance of a connector at a connector mating face is well known because the impedance of a conventional connector typically drops through the connector and across the interface of the two mating connector components. Although it is relatively easy to maintain a desired impedance through an electrical transmission line, such as a cable by maintaining a specific geometry or physical arrangement of the signal conductors and the grounding shield, an impedance drop is usually encountered in the area where a cable is mated to a connector. It is therefore desirable to maintain a desired impedance throughout the connector and its connection to the cable.

Typical signal cable terminations involve the untwisting of the wire pairs and the unbraiding of the braided shield wire surrounding the wire pairs. These wires are unbraided manually and this manual operation tends to introduce variability into the electrical performance. This is caused by unbraiding the grounding shield wires, then typically twisting them into a single lead and subsequently welding or soldering the twisted tail of a connector terminal. This unbraiding and twisting often results in moving the signal conductors and grounding shield out of their original state in which they exist in the cable. This rearrangement may lead to a decoupling of the ground and signal wires from their original state that may result in an increase of impedance through the cable-connector junction. Moreover, this twisting introduces mechanical variability into the termination area in that although a cable may contain multiple differential pairs, the length of the unbraided shield wire may vary from pair to pair. This variability and rearrangement changes the physical characteristics of the system in the termination area which may result in an unwanted change (typically an increase) in the impedance of the system in the area.

Additionally, it is common for the signal and ground termination tails of a connector to be arranged into whatever convenient space is present at the connector mounting face without any control of the geometry or spatial aspects of the signal and ground terminals being considered. When signal wires and ground shields are pulled apart from the end of a cable, an interruption of the cable geometry is introduced. It is therefore desirable to maintain this geometry in the termination area between the cable and the cable connector to reduce any substantial impedance increase from occurring due to the cable termination.

The present invention is therefore directed to a termination structure for providing improved connections between cables and connectors that provides a high level of performance and which maintains the electrical characteristics of the cable in the termination area.

SUMMARY OF THE INVENTION

Accordingly, it is a general object of the present invention to provide an improved termination structure for use in high-speed data transmission connections in which the impedance discontinuity through the cable termination is minimized so as to attempt to better match the impedance of the transmission line.

Another object of the present invention is to provide a termination assembly for use in conjunction with signal cables that provides a connection between the twisted wire pairs and grounding shield of the cable and the connector, the termination assembly having an improved electrical performance due to its structure, which eliminates large impedance discontinuities attributable to operator assembly.

A further object of the present invention is to provide an improved termination assembly for effecting a high-performance termination between a transmission line having at least one pair of differential signal wires and an associated ground and a connector having at least two signal and one ground terminal disposed adjacent to the signal terminals for contacting opposing corresponding signal ground terminals.

It is a further object of the present invention to provide such a connector wherein, by varying the size of the ground terminal and its location relative to its two associated signal wires, the impedance of the connector may be "tuned" to obtain a preselected impedance through the connector.

Yet another object of the present invention is to provide a connector for connecting cables, such as those of the IEEE 1394 type, to a circuit board of an electronic device, wherein the connector has a number of discrete, differential signal wires and associated grounds equal in number to those contained in the cables, the ground terminals of the connector being configured in size and location with respect to the signal terminals of the connector in order to minimize the drop in impedance through the connector.

It is a further object of the present invention to provide a termination assembly that provides a simple manner of termination for a signal cable in which the ground termination portion is both sized to control the impedance through the termination and to provide a nest for the grounding shield of the cable, the ground terminal portion of the connector being located rearwardly of the signal terminal portions to thereby permit the facilitation of the cable termination with selective stripping of the cable and minimal wire end preparation.

Yet still another object of the present invention is to provide a termination structure for a cable connector, the connector having a plurality of terminals, at least two of the terminals being signal terminals and one of the terminals being a ground terminal, each of the terminals having opposing contact and termination portions, the termination portions having the form of hollow, curved cups the signal terminal termination portion cups being circumscribed by the ground terminal termination portion cup so that the ground terminal termination-portion cup serves to orient the shield of the cable in a preferred orientation and to direct the placement of the signal conductors of the cable in the signal termination cups.

Yet it is still another object of the present invention to provide a connector with a unique termination structure that is particularly suitable for termination to cables, the termination structure maintaining the mechanical arrangement of the cable conductors and grounding shield as they enter the cable connector so that the signal and ground wires are maintained in an orientation that emulates that of the cable.

Yet another object of the present invention is to provide a connector for termination to a cable, wherein the ground terminal is positioned within the cable connector housing and spaced apart from two associated signal terminals in the connector housing, the ground terminal having a body portion that is larger than corresponding body portions of the two signal terminal.

A yet further object of the present invention is to provide a cable connector for use with differential signal wire pairs extending the length of the cable, the cable connector having a ground terminal and two signal terminals that are arranged in a triangular orientation throughout the connector and the termination area thereof.

In order to obtain the aforementioned objects, one principal aspect of the invention that is exemplified by one embodiment thereof includes a first connector for a circuit board which has a housing having three conductive terminals in a unique pattern of a triplet, with two of the terminals carrying differential signals, and the remaining terminal being a ground terminal. A second connector for a cable is provided that mates with the first connector and this second connector also has a triplet pattern of conductive terminals that are terminated to signal and ground wires of the cable.

The arrangement of these three terminals within the connector permits the impedance to be more effectively controlled throughout the first connector, from the points of engagement with the cable connector terminals to be points of attachment to the circuit board. In this manner, each such triplet includes a pair of signal terminals that are aligned together in side-by-side order, and which are also spaced apart a predetermined distance from each other. A contact portion of the ground terminal extends along a different plane than that of like portions of the signal terminals, while the remainder of the ground terminal extends between the signal terminals, but along the same plane as the signal terminals.

The width of this ground terminal contact portion and its spacing from the signal terminals may be chosen so that the three terminals may have desired electrical characteristics such as capacitance and the like, which affect the impedance of the connector. The width of the ground terminal is usually increased in the contact mating area of the terminals and may also be increased in the transition area that occurs between the contact and termination areas of the terminals. By this structure, a greater opportunity is provided to reduce the impedance discontinuity which occurs in a connector without altering the mating positions or the pitch of the differential signal terminals. Hence, this aspect of the present invention may be aptly characterized as providing a "tunable" terminal arrangement for each differential signal wire pair and associated ground wire arrangement found either in a cable or in other circuits.

In another principal aspect of the present invention, two or more such tunable triplets may be provided within the connector housing, but separated by an extent of dielectric material, such as the connector housing, an air gap, or both. In order to maximize the high speed performance of such a connector, the signal and ground terminals preferably all have similar, flat contacts that are cantilevered from their associated body portions so that the ground terminal contact portions may be selectively sized with respect to their associated signal terminals to facilitate the tuning of the terminals to obtain the optimum desired impedance in the connector system. When two such triple terminal sets are utilized in the connectors of the present invention, power terminals of the connector may be situated between the two triple terminal sets at a level equal to that of the ground terminals so as not to interfere with the signal terminals.

In yet another principal aspect of the present invention, the width of the ground terminal through the cable connector is varied so as to present a different surface area that increases capacitive coupling between the ground and two differential signal terminals. This change in width occurs in the terminal body portion that is interposed between the contact and termination portions of the terminals. The widths and surface areas of the signal and ground terminals may be equal in the contact areas because the cable connector terminals, when in contact with the board connector, may take advantage of the differing widths and surface areas of the board connector ground terminal contact areas. The cable connector ground terminal body portion is then varied with respect to its associated signal terminal body portions to maintain a similar dimensional relationship and spacing, preferably maintaining the triangular orientation of the three terminals.

In still another principal aspect of the present invention, the cable connector ground terminal termination portions are arranged as demonstrated in another embodiment of the invention, in a triangular orientation to maintain the spatial relationships that occur among these three terminals in the terminal body portions that are housed in the cable connector. In the preferred execution of this embodiment, the termination portions of all the terminals are curved to define hollow "nests" in receiving the cable wires therein.

Inasmuch as the size of the shield of the cable exceeds the size of internal wires, the ground termination nest is larger than the signal termination nests. The nests are preferably positioned so as to maintain the geometric relationship that exists between the signal wires and shield in the cable. The nests are preferably semi-circular to ensure accurate positioning of the signal conductors and the shield in the termination process. Thus, the ground terminal termination nest is positioned to receive and contact the grounding shield of the cable, while orienting the two signal conductors as they appear in the cable to facilitate the termination of them to the signal terminals of the cable connector.

The grounding shield termination nest extends along a semi-circular extent. If an imaginary line is drawn to continue this extent, it will encompass and enclose the signal termination nests. The termination portion nests may include extensions that extend outwardly and upwardly from the terminals, although the main extent of these terminals occurs in a general horizontal extent lengthwise out of the connector housing. These extents, as well as the center lines of the termination portions are arranged in the aforementioned triangular relationship with the ground terminal being spaced apart from and positioned above the two signal terminals. These and other objects, features and advantages of the present invention will be clearly understood through consideration of the following detailed description.

BRIEF DESCRIPTION OF THE DRAWINGS

In the course of the following detailed description, reference will be made to the accompanying drawings wherein like reference numerals identify like parts and in which:

FIG. 21 is a top plan view of another embodiment of a termination assembly for a two-channel cable constructed in accordance with the principles of the present invention;

FIG. 22A is a cross-sectional view taken through the termination assembly and schematically illustrating another facet of the triangular relationship among the signal and ground terminal termination portions;

FIG. 22B is a similar cross-sectional view to that of FIG. 22A, but schematically illustrating another facet of the triangular relationship among the signal and ground terminal termination portions where the triangle formed is a scalene triangle;

FIG. 22C is a similar cross-sectional view to that of FIG. 22A, but schematically illustrating another facet of the triangular relationship among the signal and ground terminal termination portions where the triangle formed is an obtuse triangle;

FIG. 23 is a perspective view of the terminal assembly of a cable connector constructed in accordance with the principles of the present invention with the terminals thereof shown in place upon an internal support structure;

FIG. 26 is a top plan view of another set of terminals suitable for use in the connectors of the present invention and illustrating their relative sizes and lengths;

FIG. 27 is a top plan view of a ground terminal used in the cable connectors of the present invention with a signal terminal superimposed thereover in phantom; and, FIGS. 28A–E are schematic views of the ground and signal terminal of the cable connector of FIG. 30, taken along lines A—A through E—E thereof.

DETAILED DESCRIPTION OF THE PREFERRED EMBODIMENTS

The present invention is directed to an improved connector particularly useful in enhancing the performance of high-speed cables, particularly in input-output ("I/O") applications as well as other type of applications. More specifically, the present invention attempts to impose a measure of mechanical and electrical uniformity on the termination area of the connector to facilitate its performance, both alone and when combined with an opposing connector.

Many peripheral devices associated with an electronic device, such as a video camera or camcorder, transmit digital signals at various frequencies. Other devices associated with a computer, such as the CPU portion thereof, operate at high speeds for data transmission. High speed cables are used to connect these devices to the CPU and may also be used in some applications to connect two or more CPUs together. A particular cable may be sufficiently constructed to convey high speed signals and may include differential pairs of signal wires, either as twisted pairs or individual pairs of wires.

One consideration in high speed data transmissions is signal degradation. This involves crosstalk and signal reflection which is affected by the impedance of the cable and connector. Crosstalk and signal reflection in a cable may be easily controlled easy enough in a cable by shielding and the use of differential pairs of signal wires, but these aspects are harder to control in a connector by virtue of the various and diverse materials used in the connector, among other considerations. The physical size of the connector in high speed applications limits the extent to which the connector and terminal structure may be modified to obtain a particular electrical performance.

Impedance mismatches in a transmission path can cause signal reflection, which often leads to signal losses, cancellation, etc. Accordingly, it is desirable to keep the impedance consistent over the signal path in order to maintain the integrity of the transmitted signals. The connector to which the cable is terminated and which supplies a means of conveying the transmitted signals to circuitry on the printed circuit board of the device is usually not very well controlled insofar as impedance is concerned and it may vary greatly from that of the cable. A mismatch in impedances between these two elements may result in transmission errors, limited bandwidth and the like.

Figure 11:
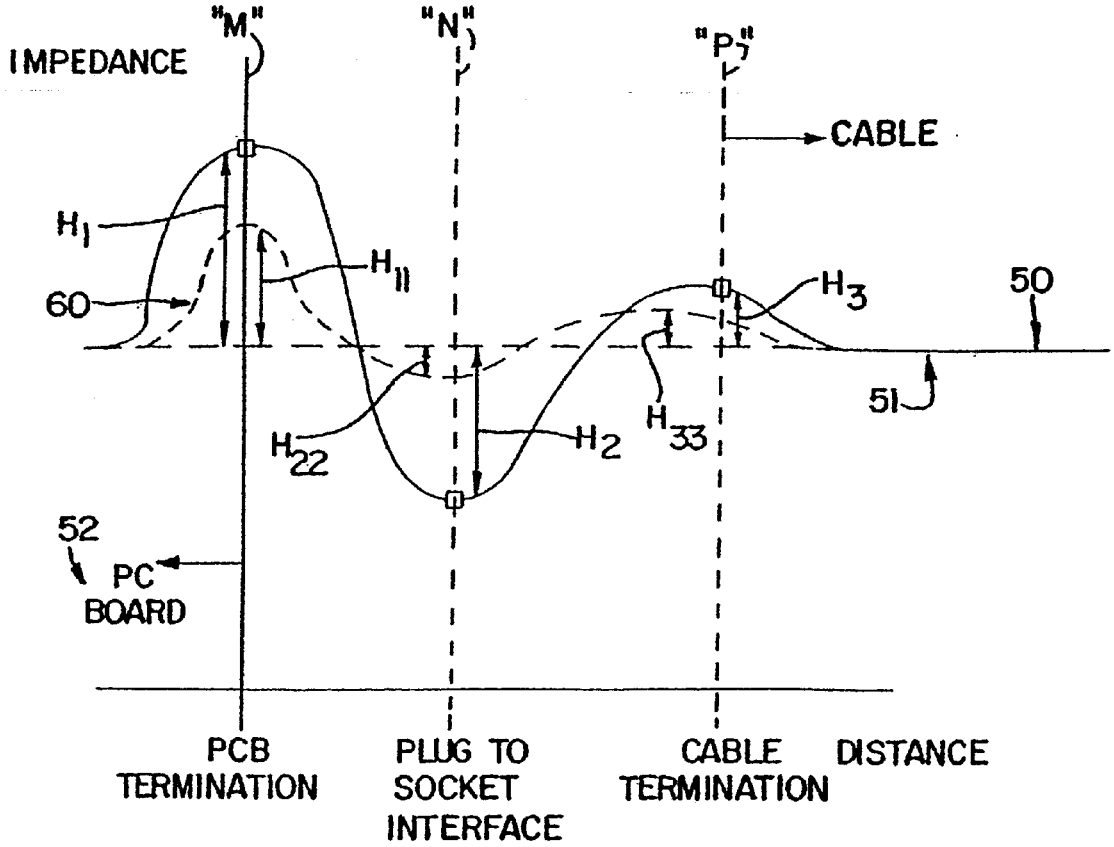
FIG. 11 is a diagram illustrating the typical impedance discontinuity experienced with a high-speed cable connection and also the reduction in this discontinuity that would be experienced with the connectors of the present invention.
Figure 12:
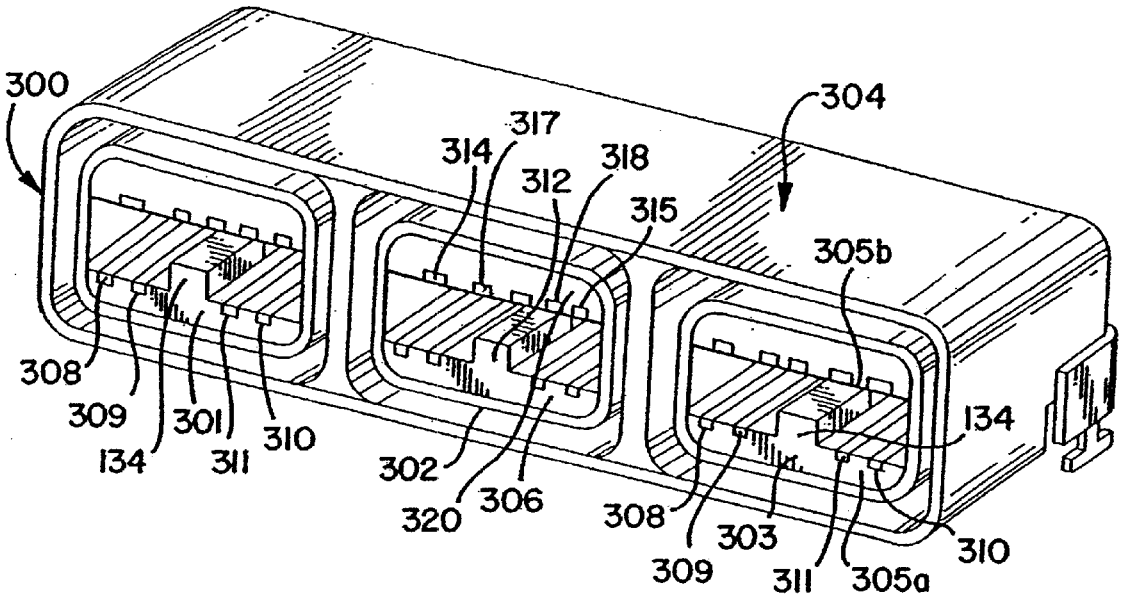
FIG. 12 is a perspective view of multiple socket-style connector in incorporating a plurality of triplet terminal arrangements in accordance with the principles of the present invention.

FIG. 11 illustrates the impedance discontinuity that occurs through a conventional plug and receptacle connector assembly used for signal cables. The impedance through the signal cable approaches a constant, or baseline value, as shown to the right of FIG. 11 at 51. This deviation from the baseline is shown by the solid, bold line at 50. The cable impedance substantially matches the impedance of the circuit board at 52 shown to the left of FIG. 11 and to the left of the "PCB Termination" axis. That vertical axis "M" represents the point of termination between the socket, or receptacle, connector and the printed circuit board, while the vertical axis "N" represents the interface that occurs between the two mating plug and socket connectors, and the vertical axis "P" represents the point where the plug connector is terminated to the cable.

The curve 50 of FIG. 11 represents the typical impedance "discontinuity" achieved with conventional connectors and indicates three peaks and valleys that occur, with each such peak or valley having respective distances (or values) $H_1$, $H_2$ and $H_3$ from the baseline as shown. These distances are measured in ohms with the base of the vertical axis that intersects with the horizontal "Distance" axis having a zero (0) ohm value. In these conventional connector assemblies, the high impedance as represented by $H_1$, will typically increase to about 150 ohms, whereas the low impedance as represented by $H_2$ will typically decrease to about 60 ohms. This wide discontinuity between $H_1$ and $H_2$ of about 90 ohms affects the electrical performance of the connectors with respect to the printed circuit board and the cable.

The present invention pertains to a connector and a connector termination structures that are particularly useful in I/O ("input-output") applications that has an improved structure that permits the impedance of the connector to be set so that it emulates the cable to which it is mated and reduces the aforementioned discontinuity. In effect, connectors of the present invention may be "tuned" through their design to improve the electrical performance of the connector.

Impedance Tunability

Figure 1A:
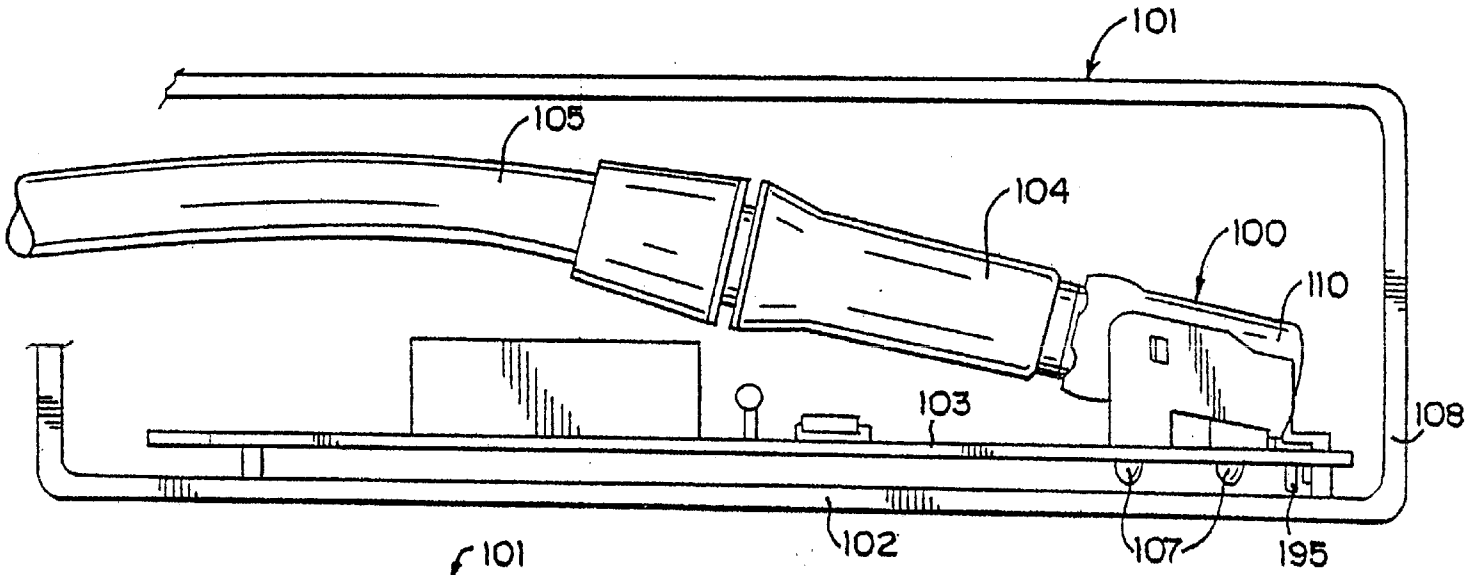
FIG. 1A is an elevational view of a cable connector assembly of the invention in place on a circuit board of an electronic device illustrating an "internal" environment in which the present invention has utility.
Figure 1B:
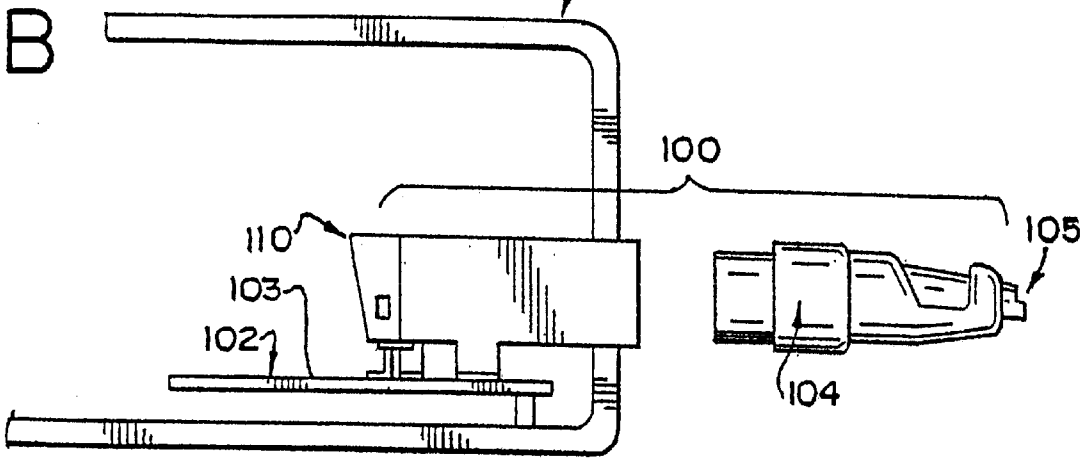
FIG. 1B is an elevational view of a cable connector assembly of the invention in place on a circuit board of an electronic device and extending to the exterior of the device to illustrate an "external" environment in which the present invention has utility.

Turning to FIG. 1, one "internal" environment is depicted in which the present invention finds significant utility. In this environment, the connectors of the present invention are disposed inside of the exterior wall 108 of an electronic device, such as a computer 101. Hence, the reference to "internal." The connectors of the present invention may also be used in an "external" application, as illustrated in FIG. 1B, wherein one of the connectors 110 is mounted to the circuit board 102, but extends partly through the exterior wall 108 of the device 101 so that it may be accessed by a user from the exterior of the device 101. The connector assembly 100 includes a pair of first and second interengaging connectors, described herein as respective receptacle (or socket) connectors 110 and plug connectors 104. One of these two connectors 110 is mounted to the printed circuit board 102 of the device 101, while the other connector 104 is typically terminated to a cable 105 that leads to a peripheral device.

Figure 2:
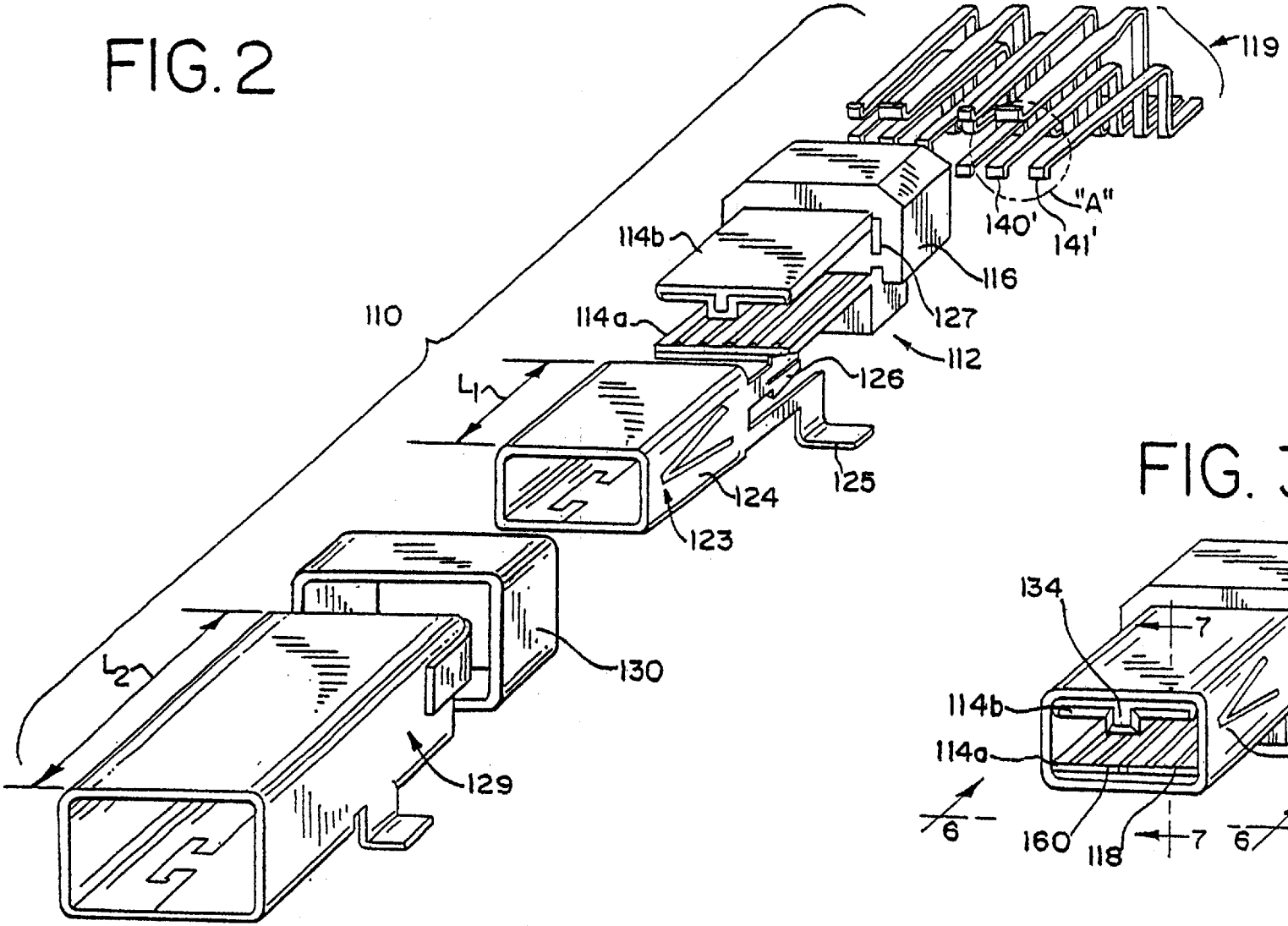
FIG. 2 is an exploded view of a cable connector in the form of a socket connection constructed in accordance with the principles of the present invention that is suitable for mounting onto a printed circuit board and opening to either the interior or exterior of the electronic device.
Figure 3:
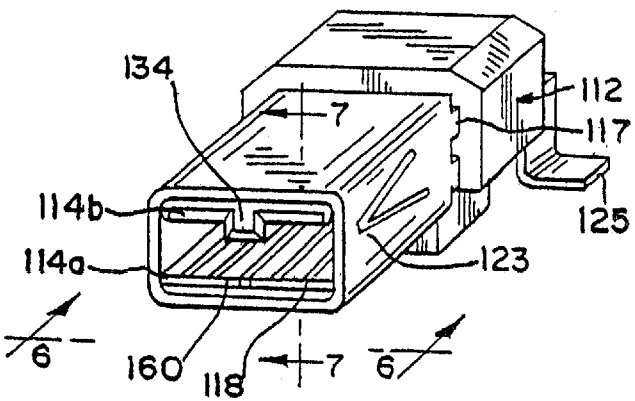
FIG. 3 is a perspective view of the socket connector and inner shield of the connector of FIG. 2.

FIG. 2 is an exploded view of a receptacle, or socket connector, 110 constructed in accordance with the principles of the present invention. The connector 110 is seen to include an insulative connector housing 112 that is formed from a dielectric material. In the embodiment depicted, the housing 112 has two leaf portions 114*a*, 114*b* that extend out from a body portion 116 of the housing 112. These housing leaf portions support a plurality of conductive terminals 119 as shown. In this regard, the lower leaf portion 114*a* has a series of grooves, or slots 118, formed therein that are adapted to receive selected ones of the conductive terminals 119 therein. The upper leaf portion 114*b*, has similar grooves 120 (FIGS. 6 & 7) that receive the remaining terminals 119 of the connector 110.

In order to provide overall shielding to the connector housing 112 and its associated terminals 119, the connector may include a first shell, or shield, 123 that is formed from sheet metal having a body portion 124 that encircles the upper and lower leaf portions 114*a*, 114*b* of the body portion 116. This first shield 123 may also include foot portions 125 for mounting to the surface 103 of the printed circuit board 102 and which provide a connection to a ground on the circuit board. Depending foot portions 107 may also be formed with the shield as illustrated in FIG. 1A for use in through-hole mounting of the connector 110, although surface mounting applications are preferred as shown in FIG. 1B. The first shield 123 may, as shown in FIG. 2, include retention members 126 that are received within and which engage slots 127 formed in the connector body portion 116.

The structure of the socket connector 110 illustrated in FIG. 2 permits it to be used in the "internal" application shown in FIG. 1, as well as in "external" applications where the connector 110 is mounted to the circuit board 102, but where the connector 110 extends partially through and is accessible from an exterior wall 108 of the electronic device.

In order to prevent accidental shocks that may occur when a cable plug connector is inserted into the socket of the receptacle connector 110, a second shield 129 may be provided that extends over the first shield 123 and which is separated therefrom by an intervening insulator element 130. The second shield 129 also has mounting feet 131 integrated therewith and will be connected to a chassis ground so that it is isolated from the circuit grounds. The second shield 129 preferably has a length $L_2$ that is greater than the length $L_1$ of the first shell so that it becomes difficult for user to contact the inner shield 123 when a cable connector is engaged with it.

As mentioned earlier, one of the objects of the present invention is to provide a connector having an impedance that more closely resembles that of the system (such as the cable) impedance than is typically found in multi-circuit connectors. The present invention accomplishes this by way of what shall be referred to herein as a tunable "triplet," which is an arrangement of three distinct terminals shown at "A" in FIGS. 2, 5A, 5B & 6. In its simplest sense, and as shown in FIG. 5A, such a triplet involves two signal terminals 140, 141 and a single ground terminal 150 that are arranged to mate with corresponding terminals of the plug connector 104 that are terminated to the wires of a differential pair of wires (preferably a twisted pair of wires) TPA+, TPA−, shown schematically in FIGS. 9A & 9B which carry the same strength signals but which are complements of each other, i.e., +1.0 volts and −1.0 volts as well as a ground complement.

Figure 7:
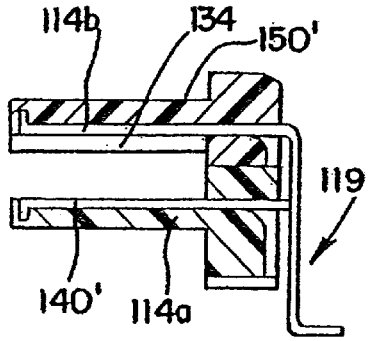
FIG. 7 is a cross-sectional view taken along lines 7—7 of FIG. 3, illustrating the receptacle connector body and the separation of the two rows of terminals thereof.
Figure 8A:
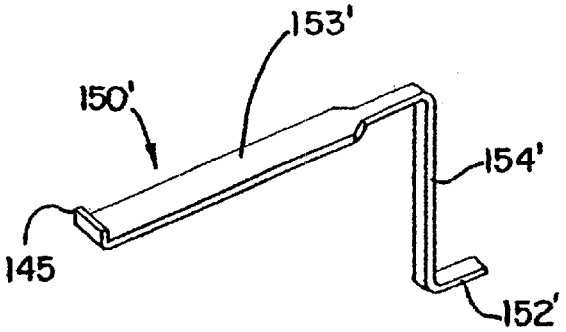
FIG. 8A is a perspective view of a ground terminal utilized in the receptacle connectors of FIGS. 2–3 and 6–7.
Figure 8B:
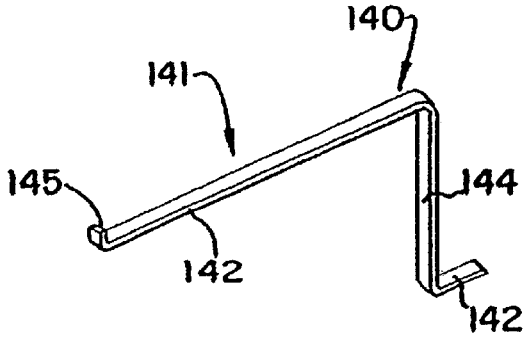
FIG. 8B is a perspective view of a signal terminal utilized in the receptacle connectors of FIGS. 2–3 and 6–7.

As shown best in FIG. 8B, the two signal terminals 140, 141 may have a cantilevered design where each terminal 140, 141 has a surface mount foot portion 142, a contact blade portion 143, and an interconnecting body portion 144. With this design, the terminals 140, 141 may be easily stamped and formed. The terminals 140, 141 are received within slots 118 of the lower leaf 114*b* of the housing body portion 116 and may include, as shown in FIGS. 2 & 7, endtabs 145 at the free ends of the contact blade portions 143 that are received in openings 117 formed in the connector housing body 116 at the ends of the slots 118. In order to "tune" the electrical characteristics of the connector and more closely resemble the impedance of the system, a single ground terminal 150 is provided in association with each set of differential signal terminals 140, 141. Hence, the term "triplet."

Figure 9A:
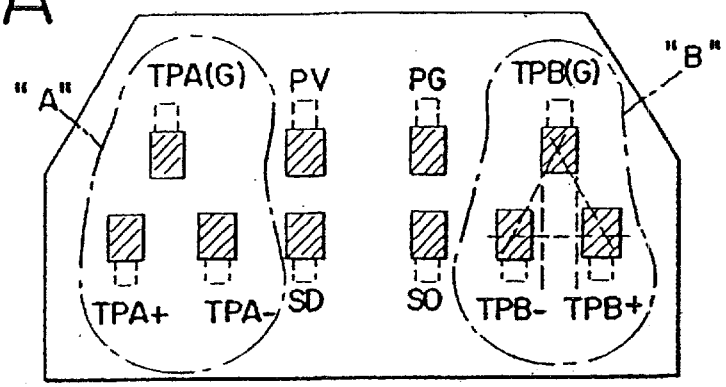
FIG. 9A is a schematic end view of the connectors of FIGS. 2–4 and 6–7, illustrating the arrangement of the various terminals relative to each other, and illustrating the use of two status information terminals.
Figure 9B:
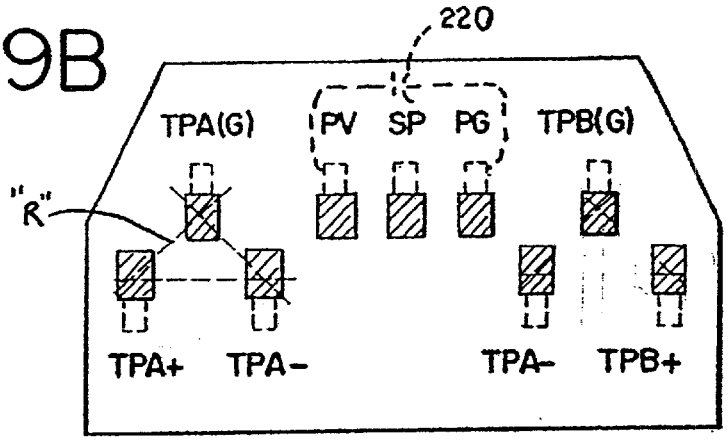
FIG. 9B is a schematic end view of the connectors of FIGS. 12–14 and 17 illustrating the arrangement and identification of the terminals and showing the use of one status information terminal.

Each such ground terminal, as shown in detail "A" of FIGS. 5A, 5B and 9A, 9B is associated with two differential signal terminals. The schematic diagrams of FIGS. 9A and 9B illustrate the triple terminal concept at "A" and "B". In the embodiments illustrated, the ground terminal 150 is located on the upper leaf portion 114*b* of the receptacle connector body 116 and between the two signal terminals 140, 141. In the schematic diagrams shown in FIGS. 9A & 9B, two such triplets are shown in a triangular orientation, with the individual terminals being identified with either an "A" or "B" suffix. Thus, TPA+ and TPA− represent the terminals for the differential signal wires of the "A" pair of wires, while TPA(G) represents the ground terminal for the "A" set of wires. Likewise, TPB+ and TPB− represent the terminals of the differential signal wires of the "B" pair of wires in the cable, while TPB(G) represents the ground terminal of the "B" wire set.

This associated ground terminal 150, as shown in FIG. 8A, also has a cantilevered design with a surface mount foot portion 152, an intermediate body portion 154 and a contact blade portion 153. As with the signal terminals, the contact blade portion 153 of the ground terminal 150 lies in a different plane than that of its intermediate body portion 154. As seen best in FIGS. 2, 8A–8B and 9C, the contact blade portions 143, 153 of the signal and ground terminals lie in different, but intersecting planes than their respective terminal body portions 144, 154. Although the preferred embodiment illustrates these two planes as being generally perpendicular horizontal and vertical planes, it will be understood that such planes need not be perpendicularly intersecting or lying in exact horizontal and vertical planes to effect the advantages of the invention. It is desirable, however, that the two planes intersect with each other.

Still further, the surface mount portions 142, 152 of the signal and ground terminals 140, 141, 150 may lie in a plane generally parallel to that of their respective contact blade portions 143, 153. The mounting portions of the signal and ground terminals may also utilize through-hole members 195 (FIG. 1A) for mounting purposes. The interaction between the surface area and location of the ground and signal terminals is explained below.

By this structure, each pair of the differential signal terminals of the cable or circuit have an individual ground terminal associated with them that extends through the connector, thereby more closely resembling both the cable and its associated plug connector from an electrical performance aspect. Such a structure keeps the signal wires of the cable "seeing" the ground in the same manner throughout the length of the cable and in substantially the same manner through the plug and receptacle connector interface and on to the circuit board. This connector interface is shown schematically in FIG. 13. and may be considered as divided into four distinct Regions, I–IV, insofar as the impedance and electrical performance of the overall connection assembly or system is concerned. Region I refers to the cable 105 and its structure, while Region II refers to the termination area between the cable connector 104 and the cable 105 when the cable is terminated to the connector. Region III refers to the mating interface existent between the cable connector and the board connector 110 that includes the mating body portion of the connectors 104, 110. Region IV refers to the area that includes the termination between the board connector 110 and the circuit board 103. The lines "P, N, and M" of FIG. 11 have been superimposed upon FIG. 13.

The presence of an associated ground with the signal terminals importantly imparts capacitive coupling between the three terminals. This coupling is one aspect that affects the ultimate characteristic impedance of the terminals and their connector. The resistance, terminal material and self-inductance are also components that affect the overall characteristic impedance of the connector insofar as the triplet of terminals is concerned. In the embodiment shown in FIG. 5B, the width $D_2$ of the ground terminal blade portion 153' is large enough so that it extends over portions of the signal terminals 140', 141'. The larger width $D_2$ of the ground terminal blade portion 153' has a larger surface area as compared to the signal terminal contact blade portions 143' and hence presents a larger and overlapping contact mating area in the region above the signal terminals 140',141'.

In order to preserve the small "footprint" of the receptacle connector 110 on the circuit board, the present invention reduces the width of the ground plane in the ground terminal body portion 154' as well as in the surface mount foot portions 152'. By reducing the width of the ground terminal 150' in its body portion 154' in the second plane thereof so that it may fit between the differential signal terminals, the distance between the signal terminals (TPA+ and TPA−) is also reduced to maintain a like capacitive coupling through the connector by maintaining a preselected substantially constant impedance between the ground terminal and the signal terminals. The impedance of the connector (as well as the coupling between the terminals) is affected by the spacing between the adjacent signal terminals 140', 141' as well as between the signal and ground terminals. Still further, the material used between the terminals, such as air, the housing material, or a combination of both, will present either a dielectric constant or a composite dielectric constant in the areas between the signal and ground terminals.

Figure 5B:
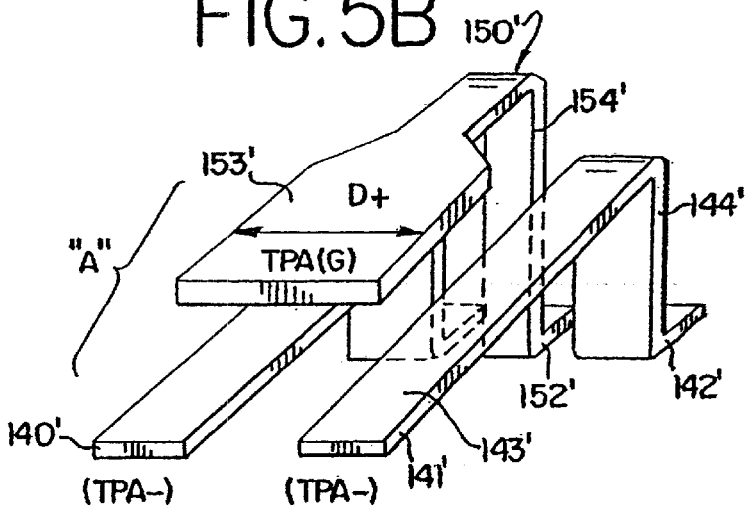
FIG. 5B is an enlarged detail view of another type of terminal triplet that may be used in the connector of FIG. 2.
Figure 5A:
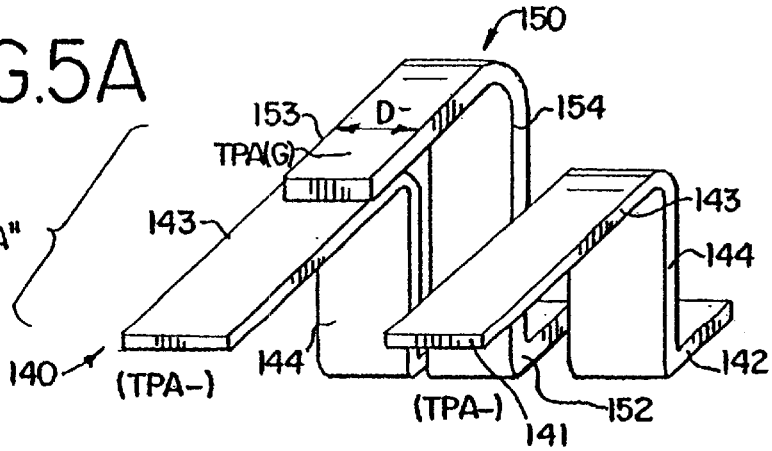
FIG. 5A is an enlarged detail view of a group of three terminals arranged in a "triplet" and used in the connector of FIG. 2 illustrating the relative size and placement of the two signal terminals and one ground terminal thereof.

By reducing the width of the ground terminal body portion 154' in the embodiment of FIG. 5B, the overlapping aspect between the contact blade portions 153', 143' of the ground and signal terminals stop in a first plane (shown as horizontal), but no longer overlap in the second, intersecting (vertical) plane. Rather, in this second plane the ground terminal body portion 154' is aligned with the signal terminals 144' in an edge-to-edge arrangement. Although there is less cross-sectional area of the ground terminal in these planes, the ground terminal is now closer to the signal terminals and hence like coupling between the terminals is maintained.

Figure 18:
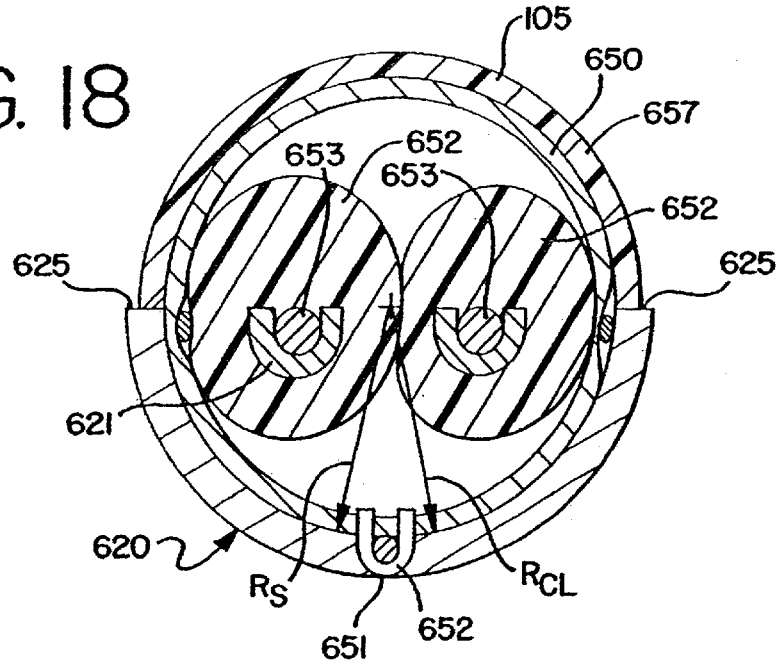
FIG. 18 is a sectional view of the termination assembly of FIG. 17 taken along lines 18—18 thereof.

In the region of the first plane, namely that of the ground and signal terminal contact blade portions which lie in the mating interface of Region III of FIG. 18, the overall plate size of the ground terminal 150' is increased relative to that of the signal terminals 140', 141' to thereby selectively diminish the impedance as referred to above. Likewise, in the second plane, occupied by both the signal ground terminal body portions 144', 154', the spacing between the ground terminal 150' and the signal terminals 140', 141' is reduced so that the ground and signal terminals are brought closer together to thereby reduce the impedance of the connector. The signal ground terminal contact blade portions 143, 143' of the triplets are preferably maintained in the same plane as illustrated in FIGS. 5A & 5B, and along the lower leaf portion 114*a* of the connector housing 112. This notably permits the impedance of the connector to be tuned from a spacing aspect but also facilitates the mechanical engagement of the two connectors. By providing a ground terminal with a larger contact blade portion, the mating contact between such terminals and the opposing ground and signal terminals of the other (plug) connector is improved without detrimentally affecting impedance.

The effect of this tunability is explained in FIG. 11, in which a reduction in the overall impedance discontinuity occurring through the connector assembly is demonstrated. The impedance discontinuity that is expected to occur in the connectors of the present invention is shown by the dashed line 60 of FIG. 11. It will be noted that the magnitude of the peaks and valleys, $H_{11}$, $H_{22}$ and $H_{33}$ is greatly reduced. The present invention is believed to significantly reduce the overall discontinuity experienced in a conventional connector assembly. In one application, it is believed that the highest level of discontinuity will be about 135 ohms (at $H_{11}$) while the lowest level of discontinuity will be about 85 ohms (at $H_{22}$). The target baseline impedance of connectors of the invention will typically be about 110 ohms with a tolerance of about +/−25 ohms. It is contemplated therefore that the connectors of the present invention will have a total discontinuity (the difference between $H_{11}$ and $H_{22}$) of about 50 ohms, which results in a decrease from the conventional discontinuity of about 90 ohms referred to above of as much as almost 50%.

Figure 6:
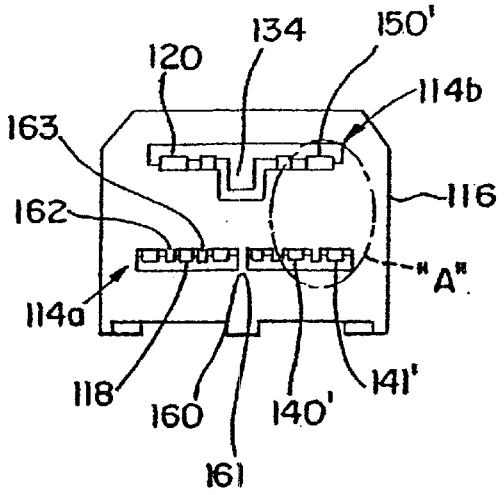
FIG. 6 is an end view taken along lines 6—6 of FIG. 3, but illustrating only the internal insulative body of the receptacle connector of FIG. 3.

The tunability and impedance characteristics may also be affected, as stated earlier by the dielectric between the terminals. In this regard, and as shown best in FIG. 6, the lower leaf portion 114*a* of the connector housing 112 may itself be slotted, as at 160 to form an air gap 161 between halves of the lower leaf portion 114*a*. Likewise, the signal (and other) terminals 140, 141 or 140', 141' may be separated from each other on the lower leaf portion 114*a* by a similar air gap 162 that is defined by a channel 163 formed in the lower leaf portion 114*a*. These channels 163, as seen in FIG. 6, extend only partially through the thickness of the lower leaf portion 114*a* so as to preserve the structural integrity of the lower leaf portion.

Figure 4:
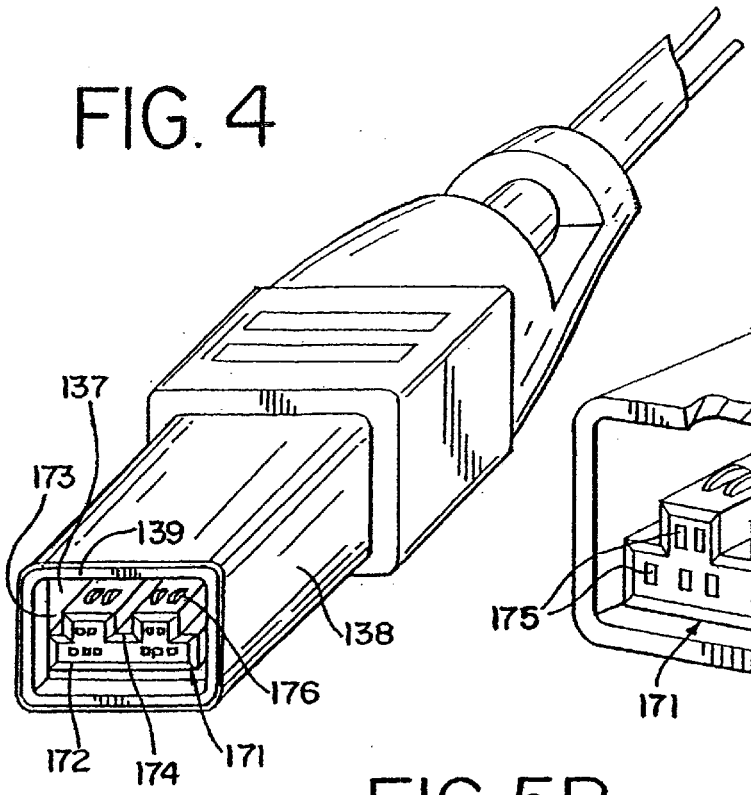
FIG. 4 is a perspective view of a cable with a plug connector terminated thereto for engagement with the socket connector of FIG. 2.
Figure 4A:
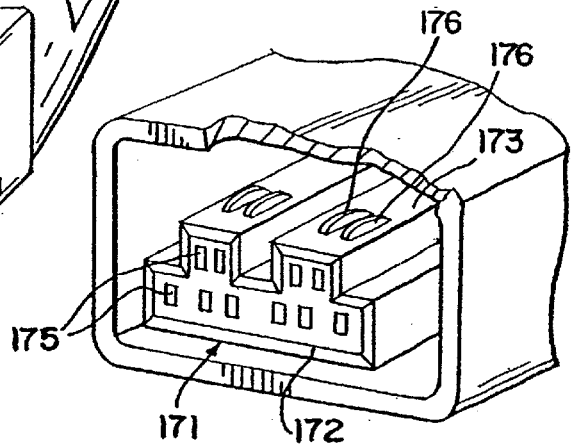
FIG. 4A is an enlarged end view of the plug-style connector of FIG. 4, with a portion of the connector cover broken away to better illustrate the terminal structure and location thereof.
Figure 9C:
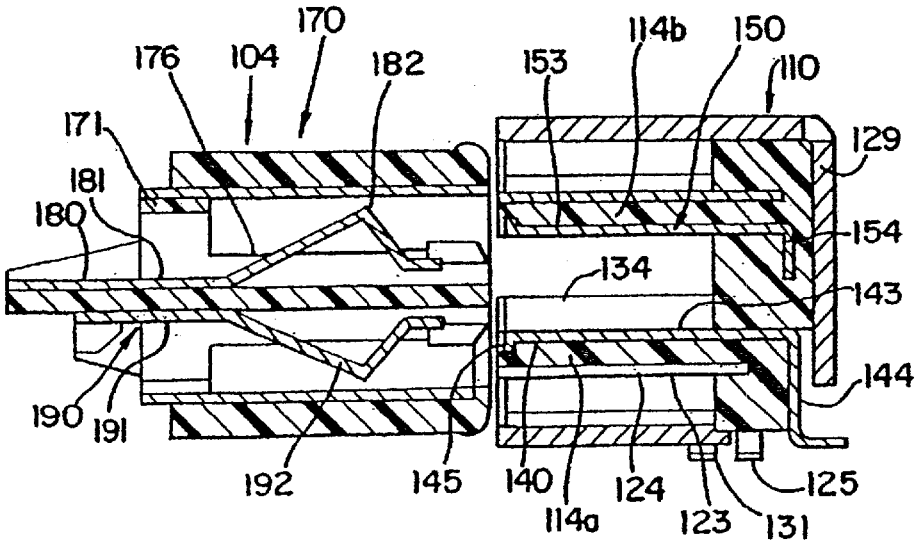
FIG. 9C is a cross-sectional view of two plug and receptacle connectors shown in preliminary engagement with each other.
Figure 17:
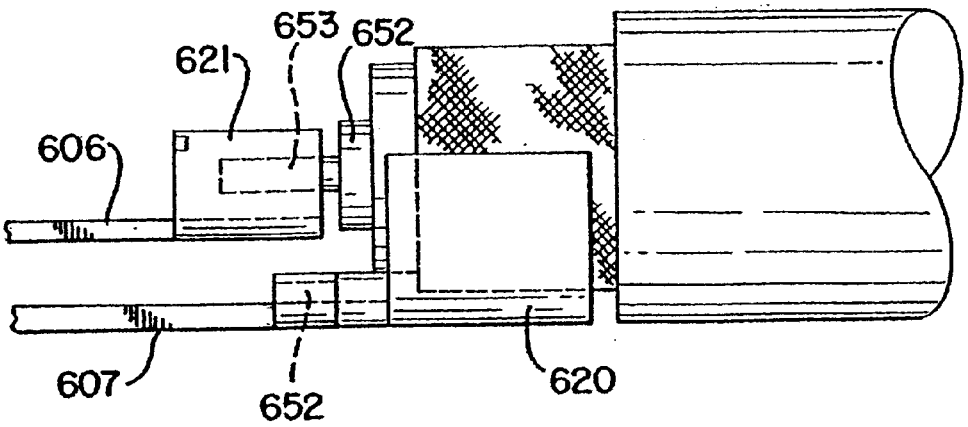
FIG. 17 is a side elevational view of the termination assembly of FIG. 16.

Turning now to FIGS. 4 and 4A, an opposing mating connector 104 is shown in the form of a plug connector 170 that has an insulative connector housing 171 formed from a dielectric material in a complimentary configuration to that of the receptacle connector 110 so as to facilitate and ensure the proper mating therebetween. In this regard, the connector housing 171 has a base portion 172 with two portions 173 that extend therefrom and which are separated by a gap 174 that serves as a keyway in the receptacle connector housing body key 134. This key 134 of the receptacle connector may be found on the upper leaf portion, as shown in FIGS. 2, 3, 6 and 7, or it may be formed on the lower leaf portion thereof as shown in FIGS. 9C and 17. The housing is hollow and contains signal, ground and other terminals held in internal cavities of the housing 171 (not shown).

Figure 10A:
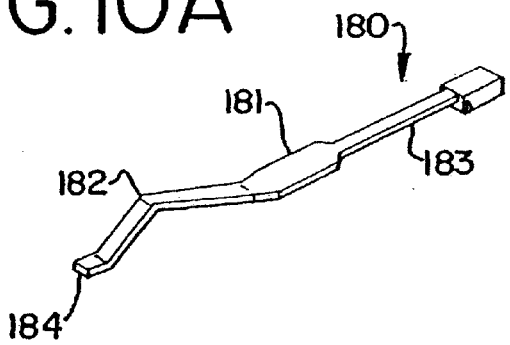
FIG. 10A is a perspective view of a ground terminal used in the plug-style connectors of the invention shown in FIGS. 4 and 12–14.
Figure 10B:
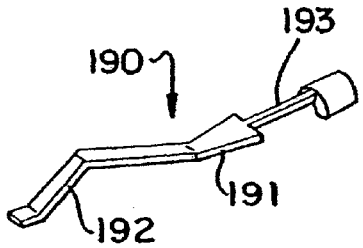
FIG. 10B is a perspective view of a signal terminal utilized in the plug-style connectors of the invention shown in FIGS. 4 and 12–14.

Two terminals are shown in FIGS. 10A and 10B which are representative of the type of terminal structure that is preferred for use in the plug connector 110. FIG. 10A illustrates a ground terminal 180 having a flat body portion 181 that interconnects a contact portion 182 to a wire termination portion 183. The terminal 180 has a free end 184 which is received in a cavity 175 at the end of the connector housing 171. The contact portion 182 is bent at an upward angle so that it will project out of a contact opening 176 in alignment with and in opposition to a corresponding ground terminal 150, or 150', of the receptacle connector 110.

The signal terminal 190 (FIG. 10B) is likewise structured and has a body portion 191 with a reduced width compared to that of the ground terminal body portion 181 in order to effect coupling between the signal and ground terminals. The body portion 191 interconnects a contact portion 192 with a termination portion 193 and the contact portion 192 is also bent at an angle to protrude through a corresponding opening 176 in the connector housing 171. These openings and the terminal contact portions appear on the lower surface of the connector base portion 172 as shown in FIG. 9C, and they are aligned with the terminal free end cavities 175 that are shown in the front face of the connector housing 171.

The grounded signal terminals 180, 190 of the plug connector 170 (as well as the other terminals) may be considered as "movable" contacts in that they are deflected toward the center of the plug connector housing 171 when the plug connector 170 is engaged with the receptacle connector 110. The grounded signal terminals 140, 141, 150 (as well as the other terminals) may be considered as "fixed" terminals because they do not move during engagement and disengagement of the two connectors. In the schematic views of FIGS. 9A and 9B, the solid rectangles represent the "movable" terminals described above, while the dashed adjacent rectangles represent the "fixed" terminals as described above. These Figures, along with FIGS. 5A and 5B illustrate the triangular relationship of the differential signal wires TPA+, TPA− with their associated ground terminal TPA(G). Each such terminal may be considered as defining a vertex of a triangle that is formed when imaginary lines are drawn interconnecting adjacent terminals as shown by the dashed lines R in FIG. 9B. In this description and in the execution of the invention, the ground terminal may be considered as being the apex, or "tip" of the imaginary triangle.

In a manner consistent with that set forth above with respect to the board connector and its signal and ground terminals 140, 140', 141, 141" and 150, 150', the terminals 180, 190 of the cable connector 170 are also structured to provide a desired impedance by way of their shapes and by way of the aforementioned triangular relationship.

As shown in FIGS. 10A and 10B, the ground and signal terminals 180, 190 each have respective contact portions 182, 192 that engage opposing contact portions 153, 143 of the ground and signal terminals 150, 140 of the opposing board connector 110. As shown in FIG. 9C, these cable connector terminal contact portions 182, 192 have a length approximately equal to the corresponding lengths of the terminal contact portions 153, 143 of the board connector 110. As might be expected; the widths and surface areas of the cable connector ground terminal contact portion 182 need not be increased because when the two connectors 110, 170 are engaged together, the geometry of the board connector contact portions 153, 143 will dominate the mated connectors and the impedance formed as a result of the mating engagement that occurs in Region III in FIG. 18.

In order to continue this desired impedance and electrical performance, as shown in FIGS. 10A and 10B and as explained above, the interconnecting body portion 181 of the ground terminal 180 is larger and preferably wider than one or both of the two signal terminal interconnecting body portions 191. This increase in width increase the surface area of the ground terminal at that area, i.e., the body portion of the connector, which increases capacitive coupling among the ground terminal 180 and its two associated signal terminals 190.

As shown in FIG. 9C, these terminals 180, 190 are also spaced apart along their contact portions 182, 192, along their body portions 181, 191 and, as illustrated by the solid rectangles of FIGS. 9A and 9B, are arranged in a triangular relationship with the cable connector ground terminal 180, and being located at the apex of the triangle. It can be seen that this triangular relationship will continue and maintain the electrical balance of the connector system throughout the interface, from the circuit board to the cable. In the preferred execution of the invention for this embodiment, the width of the ground terminal body portion 181 is preferably twice as wide as any single corresponding signal terminal body portion 191. The body portion 191 of the signal terminal 190 in FIG. 10B is shown as having a somewhat slight triangular configuration at its rear part. This specific portion serves to provide engagement points with the connector housing 171 to hold the terminals 190 in the connector housing 171 after molding. With this difference in terminal geometries, the width and surface area relationships of the board connector 110 may be likewise maintained in the cable connector 105.

Cable Connector Termination

The dimensions and configuration of the termination portions of the cable connector terminals 180, 190 may also be structured to not only maintain the beneficial electrical relationship established within both the cable 105 and the cable connector 104, but also to maintain the approximate geometry of the cable 105 in the connector termination area and to facilitate the termination of the cable 105 to such a connector 104.

Figure 14:
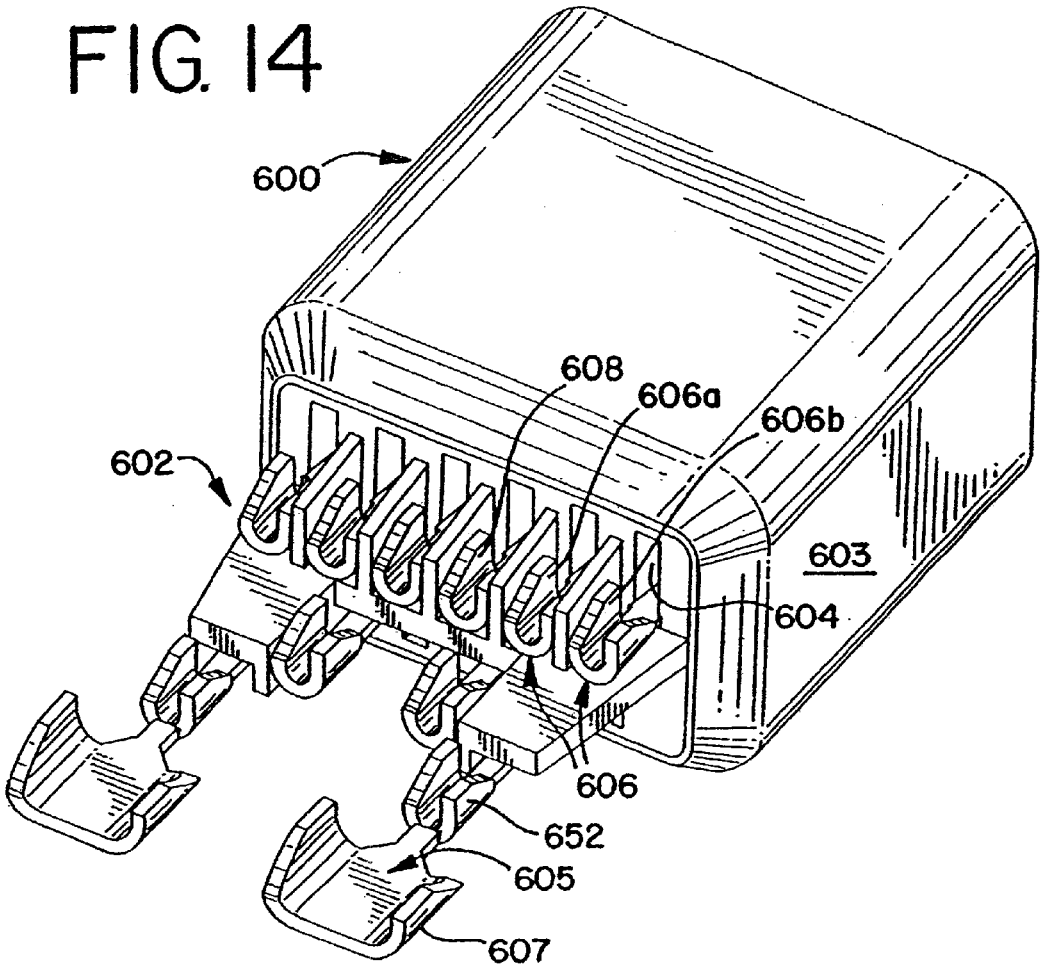
FIG. 14 is a perspective view taken from the bottom of the rear terminating face of one embodiment of a cable connector illustrating a termination structure constructed in accordance with the principles of the present invention.

FIG. 14 depicts one such cable connector 600, and in particular, the rear termination area 602 of the connector 600. The connector 600 has an insulative housing 603 that may include cavities 604 disposed therein that house conductive terminals 605. These terminals include signal terminals 606, ground terminals 607 and other terminals such as power terminals 608 and the like. The connector 600 is illustrated in FIG. 14 is shown upside down from its usual configuration with the ground terminal being disposed on top as in FIG. 9C, in order to better illustrate its associated signal terminals 606.

Figure 13:
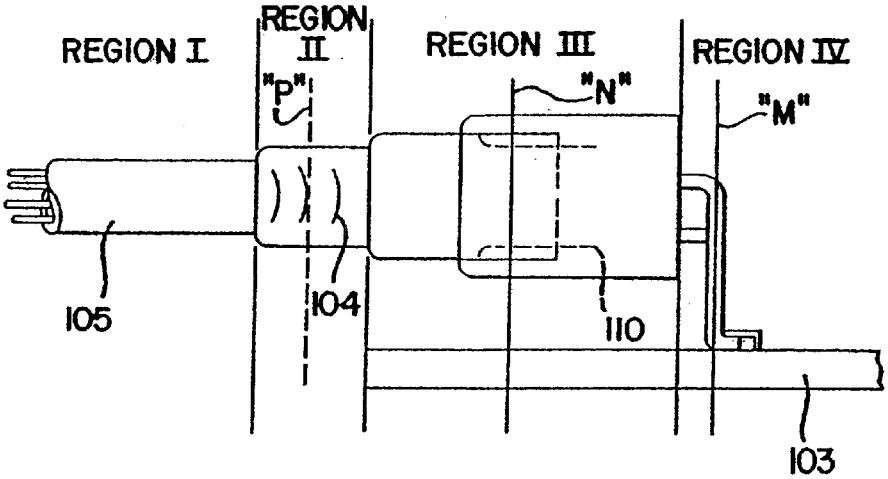
FIG. 13 is a schematic view of the connector interface area between a cable and board connector.

This embodiment of the present invention is directed in part to continuing the triplet relationship and configuration of the connector system through the termination area of Region II in FIG. 13. In this regard, two differential pair signal terminals 606*a*, 606*b* will be terminated to a corresponding pair of differential signal wires of the cable 105. A ground terminal 607 is associated with each such differential signal pair terminals 606.

Figure 15:
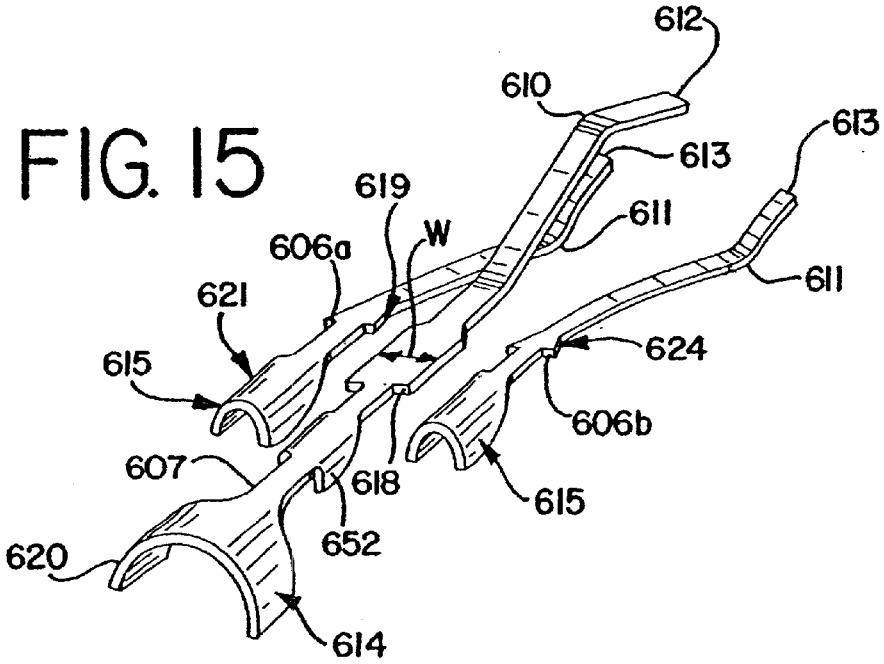
FIG. 15 is a perspective view of a set of three terminals used in the connector of FIG. 14.

FIG. 15 illustrates a set of three terminals suitable for use in the connector 600 of FIG. 14. This terminal set includes a pair of signal terminals 606*a*, 606*b* associated with a single ground terminal 607. Each terminal can be seen to include a deflectable contact portion 610, 611 with a distal end 612, 613 for engaging a slot 715 formed in the connector housing 603 (FIG. 25) and for holding the terminals in place therein so that the terminals may be preloaded, if desired. Alternatively, the terminals free ends need not be confined in any manner. The terminals 606, 607 have termination portions 614, 615 at the opposite, or proximal, ends of the terminals (when the point of reference is taken from the rear end 602 of the connector 600.) These termination and contact portions are interconnected by the corresponding signal terminal body portion 619 body portions 618, 619. The ground terminal body portion 618 has a width W that is larger than the corresponding widths of the two signal terminal body portions 619, and therefore also has a larger surface area than the corresponding signal terminal body portion 618, in order to selectively decrease the impedance in Region II. The ground terminal and body portions may also include conventional housing engagement portions, such as tangs 624 that engage the connector housing.

For the discussion that follows, the termination portions 606, 607 are not limited to the particular style connector shown, but may be considered as suitable for use as the termination portions 183, 193 of the terminals illustrated in FIGS. 10A and 10B.

Figure 16:
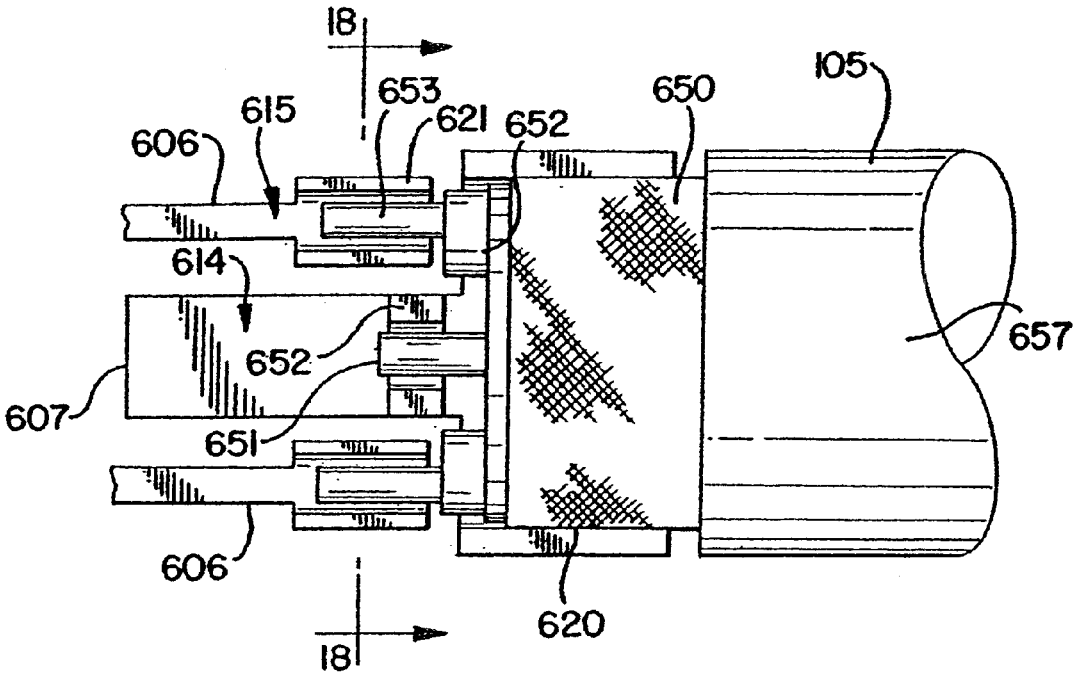
FIG. 16 is a top plan view of a cable with a stripped end in place within the termination portions of the terminals of the connector of FIG. 14, illustrating the relative positions of the signal wires and grounding shield of the cable.

As shown best in FIGS. 16–18, the termination portions 614, 615 are arranged to impose a measure of mechanical uniformity on the termination of the connector, as well as attempt to maintain the electrical uniformity established by the triangular arrangement of the terminals in the board connector 110 and the cable connector 600. In this regard, and as shown in FIG. 16, the ground terminal termination portion 614 and body portion 618 are arranged between the respective signal termination portions 615 when the assembly is viewed from the top or bottom. When viewed from the end, the ground termination portion 614 is spaced apart from the two signal termination portions 615 and these termination portions may be considered as lying in distinct planes similar to that demonstrated in FIGS. 5A and 5B. No matter what planes the terminals lie in, it is desired to maintain a triangular arrangement of the terminals.

This triangular relationship is shown diagrammatically in FIGS. 22A & 22B. In FIG. 22A, three imaginary lines $I_{1-3}$ are drawn interconnecting the centers of the three termination portions 614, 615. First, it must be noted that in FIGS. 16–18, 20A & B and 22A–C, the termination portions 614, 615 are shown upside down from their normal orientation in order to continue the ground-signal terminal arrangement of the typical connectors used to terminate the cable 105 to the circuit board 103. In this arrangement, as shown in FIGS. 5A–5B, the ground terminal 150,150' is disposed above its associated two signal terminals 140, 140', 143, 143'. This arrangement is continued in the cable connector 104, as illustrated in FIG. 9C. The imaginary lines $I_1$, $I_2$, $I_3$ drawn in FIGS. 22A–C extend through the centers C of the termination portions 614, 615 so that they intersect with each other. The resulting triangular may be equilateral as shown in FIG. 22A, or it may be a scalene triangle, with unequal length legs as shown in FIG. 22B or it may take the form of an obtuse triangle such as that shown in FIG. 22C. Other configurations may also be utilized.

Turning now to FIG. 23, it can be seen that the termination portions 614, 615 of the terminals 607, 606 take the form of nests having hollow, semi-circular solder cups 620, 621. These nests, or solder cups 620, 621 are formed integrally with their respective terminals terminating portions 614,615 and may be considered as extensions thereby. Although these extensions extend on a semi- or partly circular path as illustrated, they may take other extents, such as oval and rectangular for example. The preferred semi-circular configuration assists in positioning the cable wires properly in the termination assembly. As can be seen in FIGS. 21–23, the interior radius $R_L$ of the ground termination nest 620 approximates of the outer radius $R_S$ of the cable shield 650. As is conventional, the cable 105 includes a pair of signal lines, with inner conductors 653 surrounded by insulation 652 and which are both enclosed and in a ground shell 650, typically formed from braided wire. A grounding drain wire 651 may run on the exterior of the shield 650 and the shield and drain wire are enclosed within an outer insulative covering 657. The signal wires and their conductors 653 typically include a differential signal pair that may be twisted along the length of the cable 105. No matter the extent of the twisting, the signal wire pair will always be presented as shown in FIGS. 18–20B.

Figure 20A:
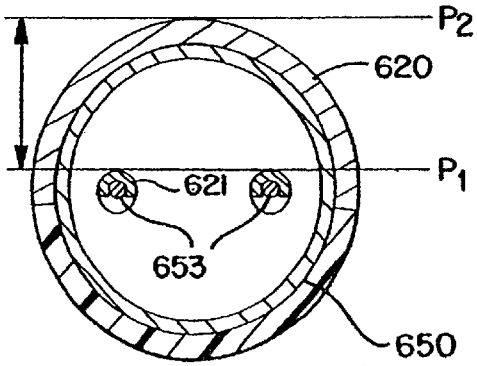
FIG. 20A is a cross-sectional view taken through the termination assembly and schematically illustrating one facet of the triangular relationship among the signal and ground terminal termination portions.
Figure 20B:
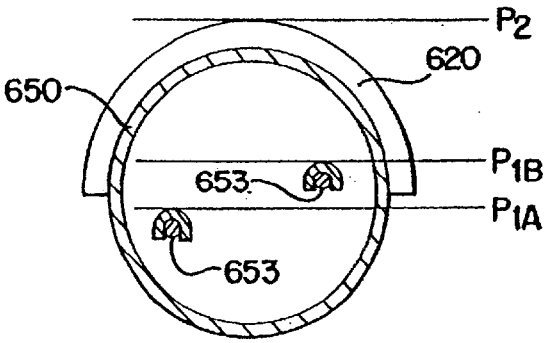
FIG. 20B is a cross-sectional view similar to that of FIG. 20A, but illustrating another facet of the triangular relationship among the signal and ground terminal termination portions.

In FIGS. 18 and 20A, the signal conductors 653 are aligned with and spaced apart from each other so that they lie in a common plane $P_1$ (when their centers are connected by imaginary lines), although the line $P_1$ that defines the plane in FIG. 20A is shown as extending along the bases of the signal termination solder cups. The signal lines may be slightly offset so that the two signal wire conductors 653 lie in two offset planes $P_{1A}$ and $P_{1B}$ as illustrated in FIG. 20B. In both such instances, the signal conductors 653 are encompassed by the shield 650 and the termination portion 614 of the ground terminals 607 is spaced apart from the signal conductors and lies in a different plane $P_2$ in FIGS. 20A and 20B than that of the signal conductors 653. The solder cups 620, 621 taper down to the conventional rectangular or square shapes of the termination portions 614, 615 after a predetermined length that follows the spacing and dimensional relationship of the board connector terminal sets 150, 140 and the plug connector terminal sets 180, 190 in order to maintain the desired triangular orientation.

Figure 19A:
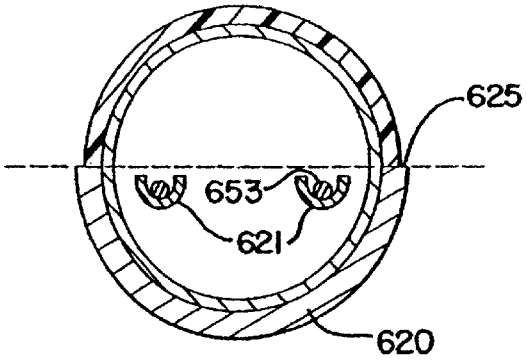
FIG. 19A is a cross-sectional view similar to FIG. 18, but schematically illustrating one positioning relationship of the signal and ground termination portions of the connector terminals.
Figure 19B:
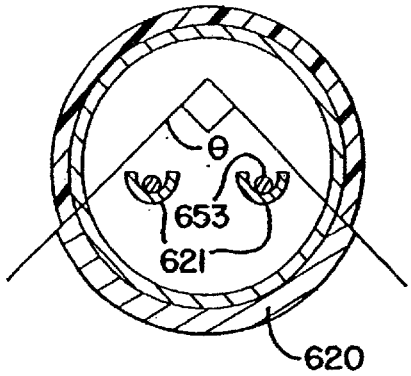
FIG. 19B is the same view as FIG. 19A, but schematically illustrating another positioning relationship of the signal and ground termination portions of the connector terminals.

As illustrated in FIGS. 19A–B, the ground termination portion solder cup 620 may have an extent such that it partially circumscribes the two signal termination solder cups 621. This extent is preferably about 180 degrees, and is shown in FIG. 19A where an imaginary line has been drawn interconnecting the free ends 625 of the ground terminal solder cup 620, and part of or all of the signal terminal solder cups 621 lie within the area bounded by the ground solder cup 620 and its free ends 625. Similarly, such a partial circumscribing occurs in the structure of FIG. 19B, where imaginary lines are drawn along the free ends 625 of the ground terminal solder cups 620 so that they intersect. The signal solder cups 621 are included within this angle θ.

The location of the ground and signal termination nests 620, 621 provides one important advantage in the present invention. They serve to match and maintain the cable geometry and further facilitate the termination of the cable to the cable connector 105. As shown in FIG. 16, the cable 105 may have its outer insulation 657 that is stripped or cut to expose the shielding 650, drain wire 651 and signal lines. The grounding shield 650 need not be unbraided and twisted into a pigtail as in the past, but rather it may be trimmed, or cut, to a specific length that will provide sufficient contact with the ground termination portion 614 and solder cup 620. Likewise, the signal line insulation 652 may be stripped to expose the signal line conductor 653. Such wire preparation may be easily performed with a jig to maintain uniform termination characteristics of the cable 105. Because the signal terminal portions 615 and their associated solder cups 621 are arranged in a fashion that preferably matches that of the cable components, the solder cups and termination portions of the connector 600 are able to present the desired triangular configuration and maintain the cable grounding. The location of the ground terminal termination portion 614 acts as a baseline guide upon which to orient and align the cable by way of its grounding shield so that the cable signal conductors are aligned with and in opposition with the signal terminal termination portions 615 of the cable connector In instances where a drain wire 651 is used, the ground terminal termination portion 614 may also include a drain wire nest 652.

As illustrated in FIG. 21, this termination arrangement may be used in multiple channel connectors where two cables 105*a*, 105*b* are terminated to a connector 700 and each cable 105*a*, 105*b* is dedicated to a particular channel. Each termination assembly indicates a ground termination nest 701*a*, 701*b* and signal termination nest 702*a*, 102*b* that are separated by an intervening wall 704 formed as either part of the connector housing 700 or as a separate framework as shown in FIG. 23. This intervening wall 704 affects the dielectric constant between the two cables 105*a*, 105*b* and also prevents inadvertent shorting between the signal lines and the grounding shield of the two cables 105*a*, 105*b*.

FIG. 23 illustrates a two-channel termination assembly 800 supported by an insulative framework 801. A connector housing (not shown) may be molded over the framework and part of the terminals to form an integral connector structure or it may be snapped into place by way of interlocking housing pieces. Each channel of the termination assembly includes one ground terminal 802 similar in general shape to the ground terminal 180 of FIG. 10A, and two signal terminals 803 that are generally similar to the signal terminals 190 of FIG. 10B.

Each ground terminal 802 has a contact portion 810 and a termination portion 811 that has a pair of extensions 812 that extend outwardly thereupon to define a nest 813 with a curved configuration to receive the shield 650 of the cable 105. The remainder of the ground termination portions 811 extend in a plane that is spaced apart from the plane(s) in which one or both of the associated signal termination portions 830 extend. The ground termination portion 811 of each channel is separated by an intervening wall 820 that extends rearwardly from the framework 801. As mentioned earlier, this wall assists in the preventing of accidental shorting from occurring between the two channels.

Figure 24:
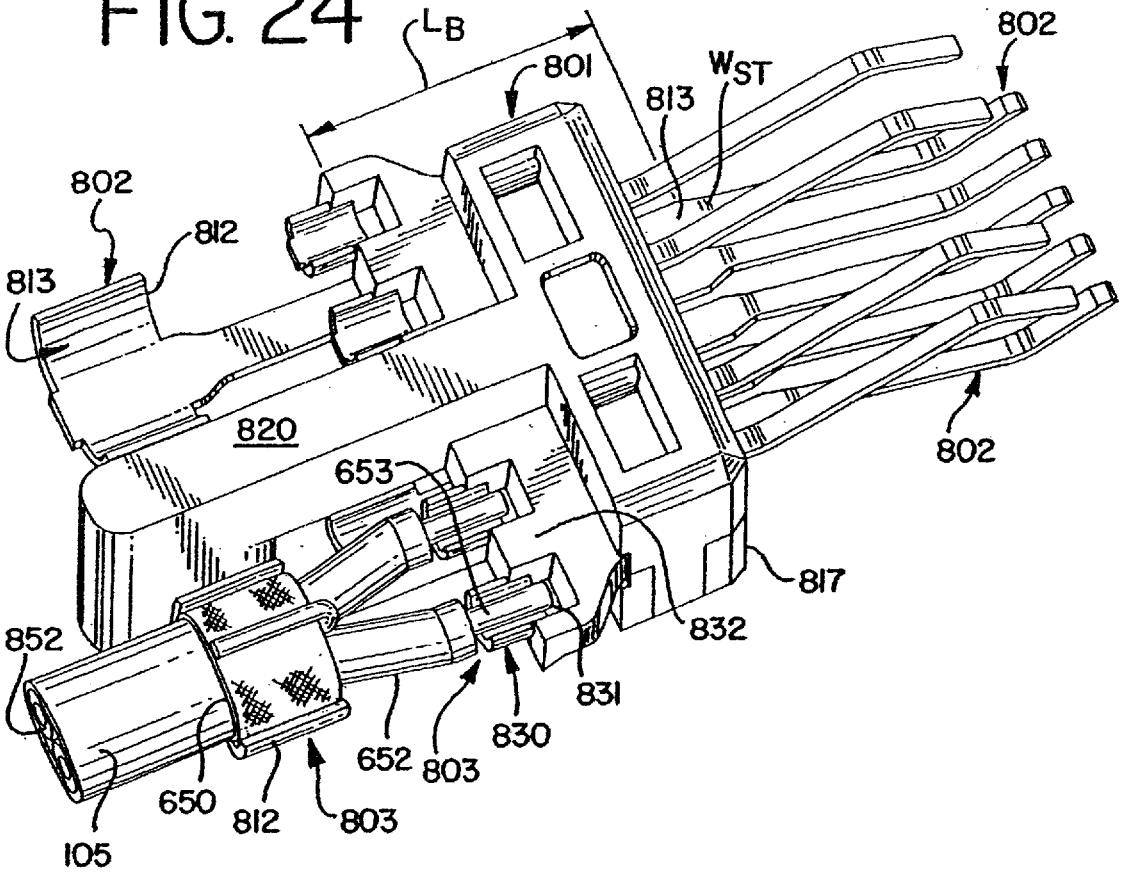
FIG. 24 is a perspective view of the terminal structure of FIG. 23, but taken from the underside thereof.

The ground terminals 803 include a body portion 813 that interconnects the termination portion 813 and contact portion 810 of the terminals together. As shown in the drawings, this body portion 813 is enlarged and has a width $W_{ST}$ that is larger than the associated ground terminal contact portion 810. The point 815 where the body portion 813 increases in its width may serve as an engagement surface against which the insulative material forming the framework 801 abuts to thereby assists in retaining the ground terminal 802 in place within the framework 801. This body portion 813 has a length $L_B$ that extends from the rear face 816 of the framework 801 to a point outside of the framework front face 817 as illustrated in FIG. 24. This ensures that the desired coupling occurs among the ground terminal 802 and its two associated signal terminals 803 through the connector housing. This increased width part $W_{ST}$ preferably occurs as a point, such as between "C" or "D" in the connector housing and shown in FIG. 25, that is either at the end of the board connector ground terminal contact portions 153' (FIG. 8A) or somewhat past the end of the of such contacts so that the wide portion of the ground terminals of each connector triple either abut or overlap a bit so as to maintain the dimensional and electrical relationship among the ground and signal terminals.

The two signal terminals 803 associated with the ground terminal 802 and making up a "triple" of the cable connector 104, have their termination portions 830 spaced apart from the ground terminal termination portions 813. These termination portions 830 include nests 835 for the conductors of the 653 of the two associated signal wires. The insulation 652 of these wires may be stripped or trimmed back to a point where the exposed conductors 653 will project therefrom for a length that is preferably equal to the length of the nests 835. These signal termination nests 835 may be partially embedded in the framework 801 or the connector housing as illustrated in FIG. 24. In this regard, the framework 801 or connector housing may be formed with slots or channels 831 that are aligned with and may serve as partial extension of the signal termination portion nests. These slots 831 are also preferably separated by intervening walls 832 that extend rearwardly a sufficient distance toward the cable so as to provide a structure that will prevent inadvertent contact between the two differential signal wires and thereby prevent shorting from occurring between them.

The signal terminals 803 take the general form as shown in FIG. 10B and include termination portions 830, contact portion 836 and body portion 837 that interconnect the contact and termination portions together in a similar manner as do the body portions of the ground terminals 802. The body portions 837 of these signal terminals 803 may include tangs 838 that will engage the connector housing, preferably by embedding in the molding process.

FIG. 26 illustrates another form that the ground terminal 802 and the signal terminals 803 may take, while FIG. 27 illustrates the signal terminal superimposed on the ground terminal in dashed lines. This Figure illustrates another form that the width relationship between the ground and signal terminals may take. It can be seen that the ground terminal body portion is wider in its body portion that the body portion of the signal terminal and the ground terminal has a larger surface area than the signal terminal in order to effect the aforementioned coupling aspect among the three terminals.

Figure 25:
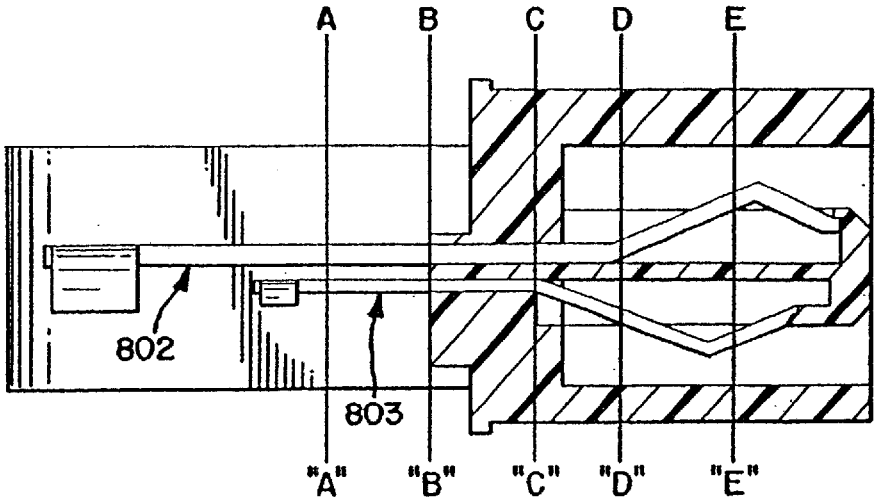
FIG. 25 is a longitudinal cross-sectional view taken through a cable connector and schematically illustrating the signal and ground terminals of FIGS. 23 and 24 in place within the cable connector housing.

FIGS. 28A–E illustrate the relative spacing that occurs between the ground terminal 802 and the signal terminals 803 in a cable connector such along the longitudinal extent of the connector as shown in FIG. 25 and which utilizes a cable termination assembly such as that illustrated in FIGS. 23 & 24. These Figures illustrate how the triangular relationship is maintained throughout the connector. By manipulating the distance between the ground and signal terminals 606, 607, the impedance of the system may be changed, or "tuned." This is done because capacitive coupling occurs between the two signal wires (and terminals) as well as each of the signal lines and the grounding shield (and terminals). The spacing of the terminals also affects the impedance of the system. The widths of the ground and signal terminals also affects the coupling and the impedance of the system, which also includes the resistance of the terminals, which in turn is also a function of the dimensions of the terminals.

While the preferred embodiments of the invention have been shown and described, it will be apparent to those skilled in the art that changes and modifications may be made therein without departing from the spirit of the invention, the scope of which is defined by the appended claims.

We claim:

1. A differential signal connector for mating with an opposing differential signal connector, comprising:

a connector housing formed of an electrically insulative material;

a triplet of conductive terminals disposed in said housing, the triplet including one ground terminal and two differential signal terminals associated with said ground terminal, each of the terminals including a contact portion for engaging a corresponding terminal contact portion of the mating connector, a termination portion for terminating said terminal to said grounding shield or differential signal terminals of said cable, and a body portion interconnecting said terminal and termination portions together, said body portions being at least partially supported within said housing;

said grounding terminals and said differential signal terminals being arranged, from said contact portions thereof to said termination portions thereof, in a triangular orientation lengthwise throughout said connector, whereby said ground and signal terminal termination portions are disposed in a triangular configuration when said connector is viewed from a terminating end thereof.

2. The differential signal connector of claim 1, wherein, said ground and signal terminals are arranged in a triangular configuration when said connector is viewed from a mating end thereof.

3. The differential signal connector of claim 1, wherein, said signal termination portions are spaced horizontally apart from each other and said signal termination portions are spaced vertically apart from said ground termination portion.

* * * * *